US009526939B2

(12) United States Patent
Longfellow

(10) Patent No.: US 9,526,939 B2
(45) Date of Patent: Dec. 27, 2016

(54) CORE EXERCISE SUPPORT DEVICE

(71) Applicant: Paul Longfellow, Lonetree, CO (US)

(72) Inventor: Paul Longfellow, Lonetree, CO (US)

( * ) Notice: Subject to any disclaimer, the term of this patent is extended or adjusted under 35 U.S.C. 154(b) by 24 days.

(21) Appl. No.: 14/520,656

(22) Filed: Oct. 22, 2014

(65) Prior Publication Data

US 2015/0111709 A1 Apr. 23, 2015

Related U.S. Application Data

(60) Provisional application No. 61/894,071, filed on Oct. 22, 2013.

(51) Int. Cl.
*A63B 26/00* (2006.01)
*A63B 21/068* (2006.01)
*A63B 23/02* (2006.01)

(52) U.S. Cl.
CPC ..... *A63B 21/068* (2013.01); *A63B 21/4039* (2015.10); *A63B 23/0211* (2013.01)

(58) Field of Classification Search
CPC ..... A63B 23/0205; A63B 21/0047; A63B 21/4029; A63B 21/4007; A63B 21/4009; A63B 21/4027; A63B 21/4037; A63B 21/40392
See application file for complete search history.

(56) References Cited

U.S. PATENT DOCUMENTS 1,904,039 A * 4/1933 Bruder ..... A61H 7/001 482/142
3,730,919 A * 5/1973 McGinn ..... C08G 18/089 264/48
4,132,228 A * 1/1979 Green ..... A47C 7/022 297/284.3
5,033,742 A * 7/1991 Johnson ..... A47C 15/006 441/130
6,110,194 A * 8/2000 Saber ..... A61H 1/008 5/633
6,336,895 B1 * 1/2002 Dukes ..... A63B 21/4039 482/140
8,591,388 B2 * 11/2013 Jahns ..... A63B 23/0211 482/140
8,870,727 B2 * 10/2014 Palmer ..... A63B 21/02 128/845
2008/0176725 A1 * 7/2008 Mehendale ..... A63B 21/00047 482/142
2010/0187888 A1 * 7/2010 Gallegos ..... A47C 7/022 297/411.2
2011/0207587 A1 * 8/2011 De La Rambelje ..... A63B 21/00047 482/140
2013/0253582 A1 * 9/2013 Tielve ..... A61H 1/0292 606/240

* cited by examiner

*Primary Examiner* — Loan H Thanh
*Assistant Examiner* — Megan Anderson
(74) *Attorney, Agent, or Firm* — Calfee, Halter & Griswold LLP

(57) ABSTRACT

The preferred embodiment of the invention provides relief from pressure, increased friction and skin-to-skin interaction, particularly in the lower lumbar, sacral and coccyx areas to a person exercising when performing Seated Core Exercises by means of a lumbar support and posterior support. Said posterior support is preferably further characterized by a recess or void to provide pressure relief in the region near the user's posterior proximal to the coccyx and sacral areas.

20 Claims, 5 Drawing Sheets

CORE EXERCISE SUPPORT DEVICE

CROSS-REFERENCE TO RELATED APPLICATIONS

This application claims the benefit of U.S. Provisional Application 61/894,071 filed Oct. 22, 2013.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

CERTIFICATE OF TRANSMISSION

I hereby certify that this correspondence, which includes 20 pages of Specification and 5 sheets of Drawings, is being electronically deposited with the United States Patent & Trademark Office, EFS-Web filing portal under 37 C.F.R. 1.8, addressed to: Commissioner for Patents, on the date shown below. /*Jeffrey R. Schell*/Date of Electronic Transmission: 21 Oct. 2014 WITNESS: Jeffrey R. Schell

BACKGROUND OF THE INVENTION

Seated Core Exercises such as sit-ups and abdominal crunches represent commonly accepted exercises that strengthen core muscles. Such core muscles include, among others, the hip flexors, rectus abdominus, iliopsoas, tensor fasciae latae, rectus femoris, Sartorius and oblique muscles.

It is well known among those skilled in arts related to physical fitness activities that pain associated with the coccyx and/or tailbone areas commonly follows the performance of abdominal exercises, such as abdominal crunches or sit-up exercises. A prevailing belief is that such coccyx and/or tailbone region pain is caused by the repetitious contact with the ground associated with physical activities associated with abdominal crunches, sit-ups, and associated exercises.

Furthermore, pain and discomfort may occur as a result of friction between the lower spinal regions and associated anatomical features and the ground. Such lower spinal regions and associated anatomical features include the areas surrounding the coccyx, the sacrum and the lumbar regions, representing areas of the body that maintain and experience the most movement and contact with the ground when performing fitness movements including abdominal crunches, sit-ups, and associated exercises.

Discrete areas of skin which come into contact at the interaction of parts of the body surrounding the sacral area and the coccyx areas represent yet another cause of the discomfort and pain deriving from contact pressure and friction resulting from fitness movements including abdominal crunches, sit-ups, and associated exercises. For instance, in a seated position, abdominal movements create increased skin-on-skin interaction, movement and friction between medial portions of the gluteous maximus. Such increased friction, movement or interaction often results in discomfort. Such discomfort may include skin irritation and chafing. The painful outcomes associated with fitness movements result in drawn out healing processes, in which scabbing and scarring persists. This is a significant problem in the fields of physical therapy and athletic training, as such scarring, scabbing and associated conditions take significant time to heal, resulting in delays and/or reductions in fitness related and rehabilitation related activities. Resultantly, the subject, often a patient or athlete, remains unable to perform exercises requiring a seated position for some time following the onset of such conditions.

Some items known in the prior art attempt to alleviate discomfort by providing support in a radial convex arch to provide curvature support to the lumbar region while performing Seated Core Exercises in coordination with natural lumbar curvature in the spine often referred to as the lumbosacral and lumbolumbar curvature. It will be appreciated by one skilled in the art that the term "Seated Core Exercise" as used herein refers to any core exercise that involves a seated position, including but not limited to exercises such as sit-ups, abdominal crunches, Russian twists, Turkish get-ups, and other core strengthening exercises that are performed involving a seated, supine or intermediate position thereof. Most such devices fail to address issues associated with anatomical friction. Generally, they fail to adequately address issues associated with friction and pressure associated with the contact between a body and the ground and skin-on-skin friction.

Other devices in the prior art attempt to alleviate friction with the ground as well as skin-on-skin interaction with the combination of a convex contoured lumbar support coupled with a posterior support constructed of a generally softer material than that of the ground or seating surface available to a user of such devices when performing Seated Core Exercises. Such devices provide a flat or substantially planar posterior support. However these and similar devices fail to support the basic form of the human anatomy in a manner that distributes the load of the user sufficiently in order to prevent concentrated loads. The failure of such devices to solve the occurrence of concentrated loads compounds the problem of pain and discomfort in the execution of Seated Core Exercises.

Other previously known devices utilize a flat support surface, often with cushioning. The human posterior region, including the buttocks, is a substantially convexly radial form. A flat support surface as provided in the prior art, creates a limited interface surface between the user's posterior and the device in use at the tangential point of contact between the rounded posterior and flat support. Such devices fail to provide the contoured support needed to adequately relieve pain and discomfort.

Other devices known in the prior art associated with Seated Core Exercises attempt to alleviate pain or discomfort during the performance of Seated Core Exercises via a pressure mitigation solution for the spine. Such devices generally provide a groove or recess for the spine to rest in in conjunction with a convex contoured lumbar support. In doing so, the pressure or friction impacting the spine during such exercises is alleviated. However, this does not solve the problems associated with pressure, increased friction or skin-to-skin interaction in the sacral or coccyx area.

SUMMARY

The preferred embodiment of the invention comprises an apparatus providing relief from pressure, increased friction and skin-to-skin interaction, particularly in the lower lumbar, sacral and coccyx areas to a person when performing Seated Core Exercises by means of a lumbar support and posterior support. Said posterior support is preferably further characterized by a recess or void to provide pressure relief in the region near the user's posterior proximal to the coccyx and sacral areas.

REFERENCE NUMERALS

Figure 1:
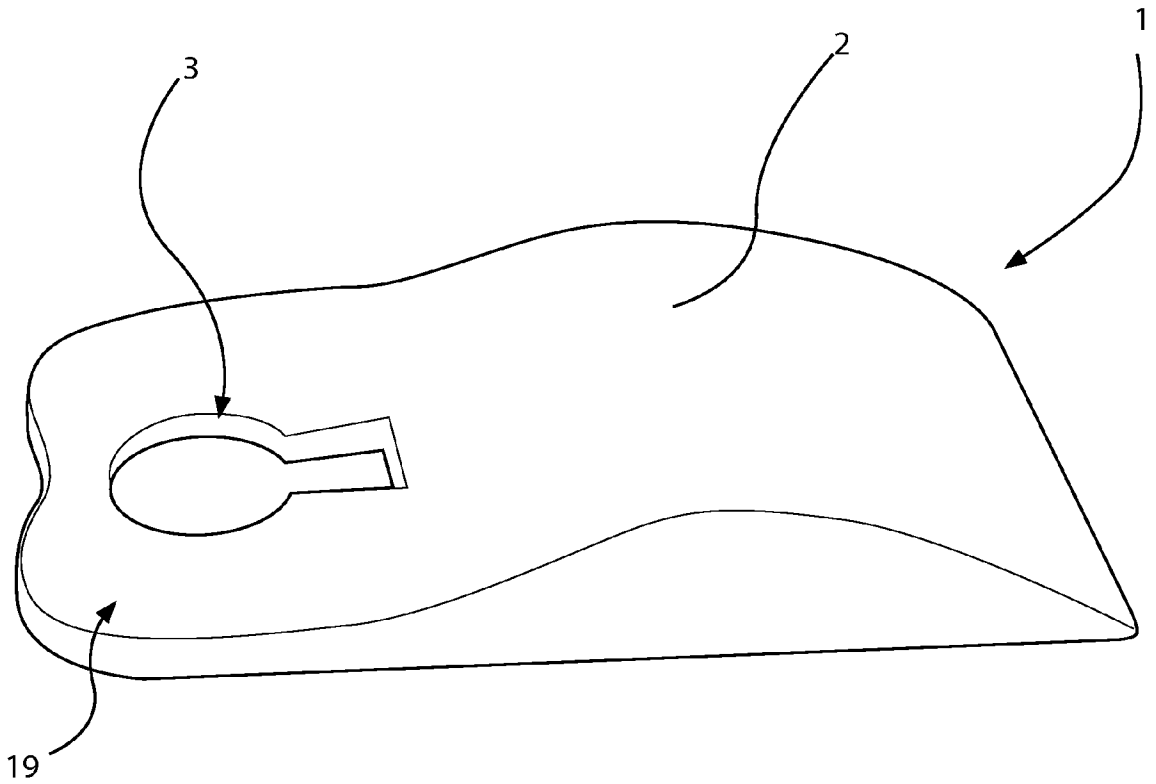
FIG. 1 is a view of an embodiment of the exercise support device incorporating a posterior support, lumbar support and recess.

1. Core Exercise Support Embodiment
2. Convex Countered Lumbar Support Embodiment
3. Recess Embodiment
4. An exemplary user
5. Representation of the skeletal system of a user
6. Right Ilium representation of a user
7. Left Ilium representation of a user
8. Right Femur representation of a user
9. Left Femur representation of a user
10. Coccyx representation of a user
11. Sacrum representation of a user
12. L5 Vertebra representation of a user
13. L4 Vertebra representation of a user
14. L3 Vertebra representation of a user
15. L2 Vertebra representation of a user
16. L1 Vertebra representation of a user
17. T12 Vertebra representation of a user
18. T11 Vertebra representation of a user
19. Posterior Support Embodiment
20. Interface Layer Embodiment of Exercise Support Device
21. Structural Layer Embodiment of Exercise Support Device

DETAILED DESCRIPTION

Figure 3C:
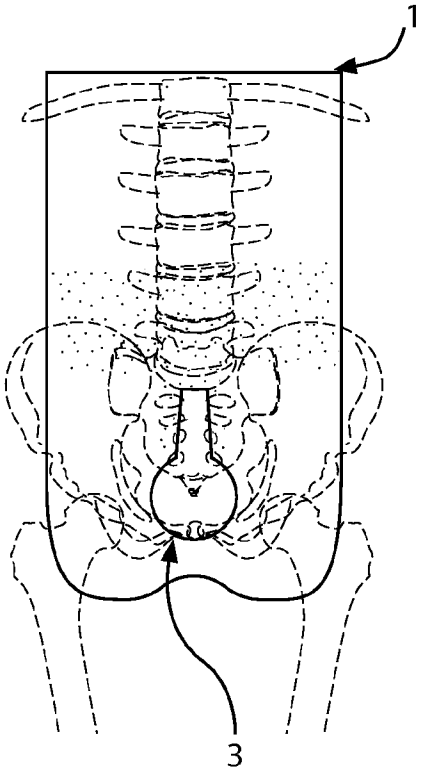
FIG. 3C is a top view of an embodiment of the exercise support device demonstrating a transparent view of the user's skeletal structure coordinated with the posterior support, lumbar support and recess.
Figure 3B:
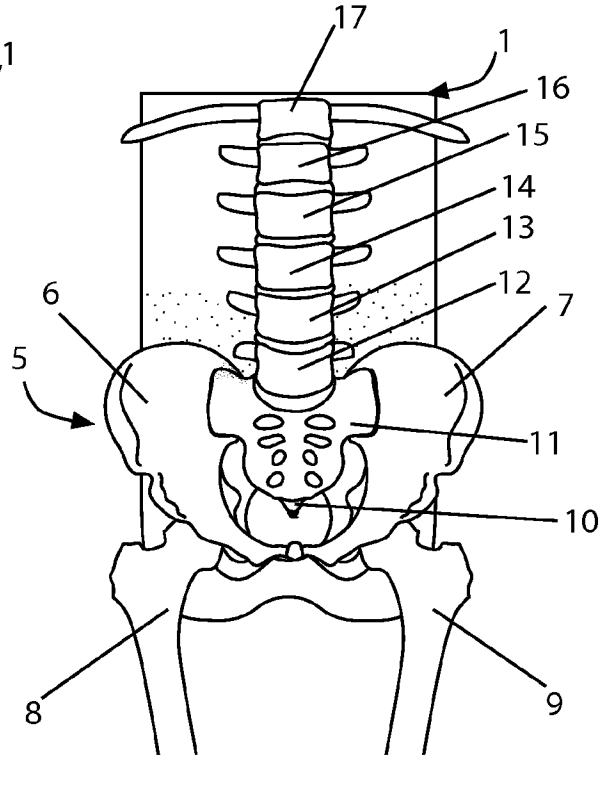
FIG. 3B is a top view of an embodiment of the exercise support device demonstrating the user's skeletal structure coordinated with the posterior support, lumbar support and recess.
Figure 3A:
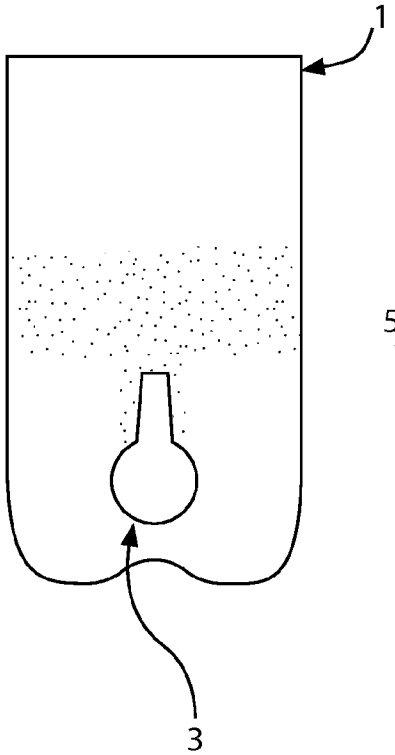
FIG. 3A is a top view of an embodiment of the exercise support device
Figure 4A:
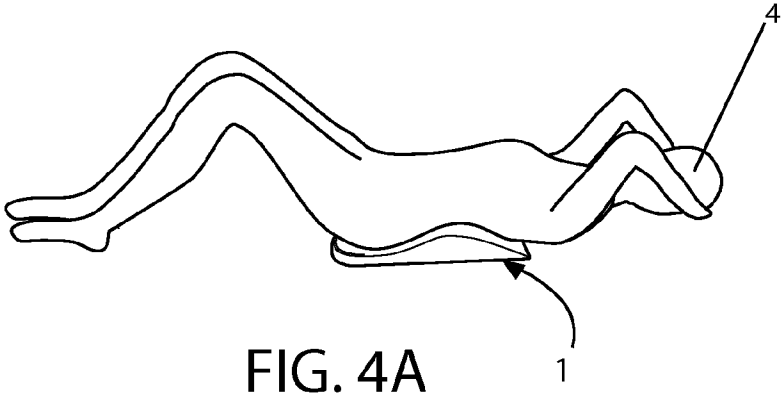
FIG. 4A is a perspective view demonstrating the use of an embodiment of the exercise support device in a supine position
Figure 4B:
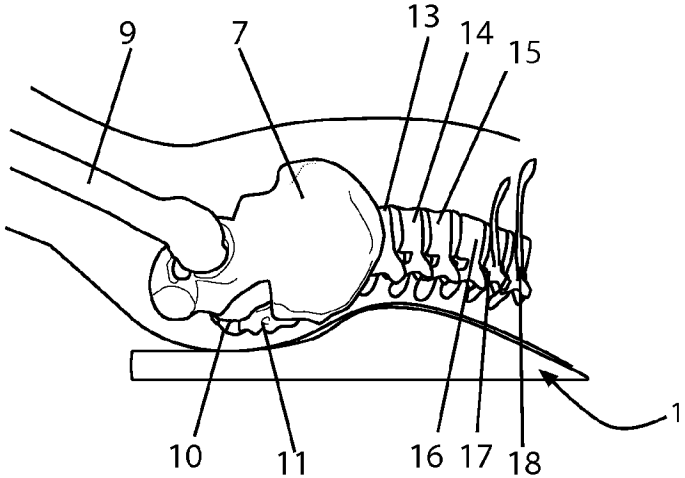
FIG. 4B is a side view demonstrating the supine position of the user and the orientation of the skeletal structure of the user.
Figure 4C:
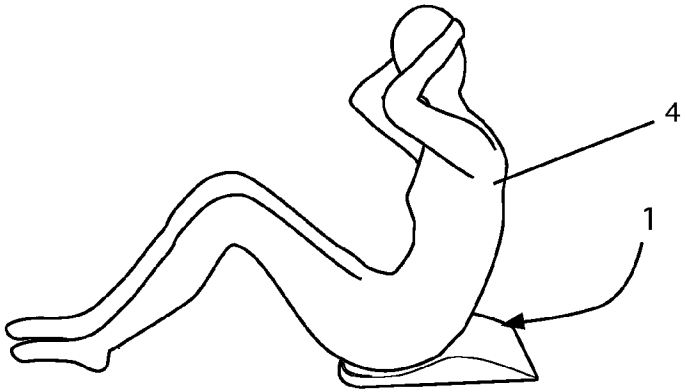
FIG. 4C is a perspective view demonstrating the use of an embodiment of the exercise support device in a seated position
Figure 4D:
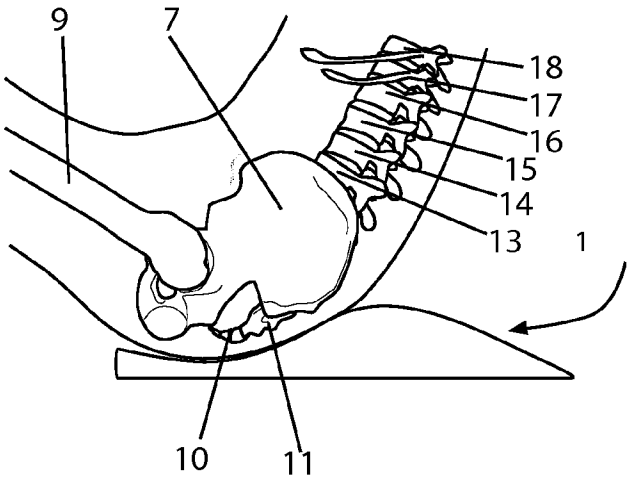
FIG. 4D is a side view demonstrating the seated position of the user and the orientation of the skeletal structure of the user.
Figure 5A:
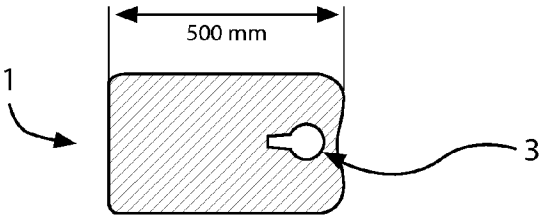
FIG. 5 A is a Top view of the preferred embodiment
FIG. 5B is a top view of the preferred embodiment
FIG. 5C is a side view of the preferred embodiment
FIG. 5D is a front view of the preferred embodiment
FIG. 5E is a top view of the preferred embodiment
Figure 5B:
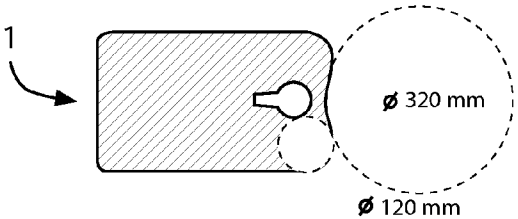
Figure 5C:
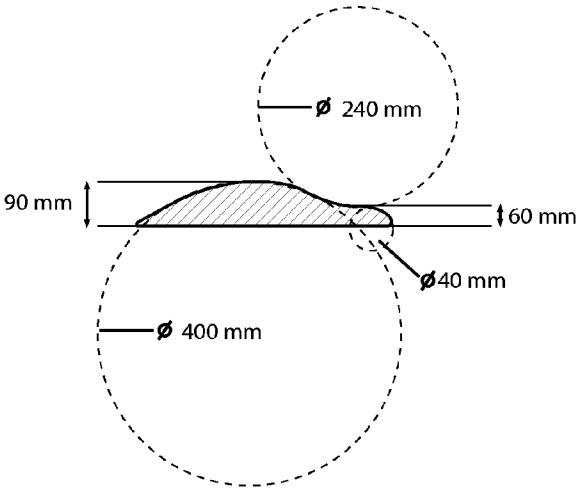
Figure 5D:
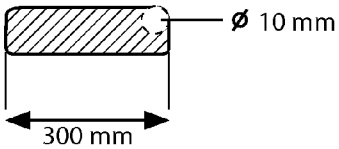
Figure 5E:
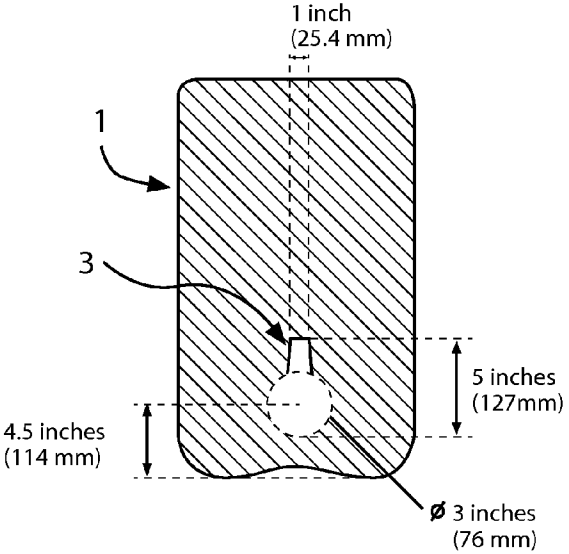

The invention provides a solution to the problem of discomfort or pain associated with Seated Core Exercises, particularly in the coccyx and sacral areas. The preferred embodiment of the invention, as shown in FIGS. 3A, 3B and 3C comprises a exercise support device for use during Seated Core Exercises that includes a posterior support 19 and a recess 3 encompassing a portion of the region proximate to the user's coccyx and sacral areas. The recess 3 is oriented along the sagittal plane of the user. In the preferred embodiment, the recess 3 is oriented to allow the coccyx to rest substantially in the middle of a radial section of the recess 3 and a narrower section to laterally encompass the Supraspinous Ligament until the superior surface of the sacrum 11 centered along the sagittal plane of the user as demonstrated in FIG. 3C. Said posterior support 19 provides a cushioned support structure between the user's posterior and the floor or other seated surface in a substantially concave curvature providing a larger and more consistent support interface to the user's posterior by providing a radial contact interface to accommodate the natural curvature in the posterior region of a user.

In an embodiment incorporating the inventive elements of the concept, an exercise support device comprises posterior and lumbar supports intended for support beneath the posterior and lumbar regions of a user. In the preferred embodiment, the posterior support 19 further comprises a recess 3 that encompasses a region proximate to the user's coccyx and sacral areas for use during Seated Core Exercises. It is further preferred that the recess 3 comprises a void of material, or thru-hole, encompassing a region designed as proximate to the users coccyx and sacral areas during use while performing Seated Core Exercises.

In an embodiment of the invention, an exercise support device comprising a posterior support and an integrated lumbar support provides mitigation of pain or discomfort in the execution of Seated Core Exercises through the use of contoured curvatures. Such curvatures are designed to provide a natural support to match the curvature of the posterior as well as the curvature associated with the lumbar region as demonstrated by FIGS. 4A, 4B, 4C and 4D. The posterior support provides a substantially concave curvature while said lumbar support provides a substantially convex contoured surface. With said posterior support oriented beneath the posterior region, said lumbar support provides a cushioned support structure between the floor and the user's posterior lumbar regions in a supine position and mitigates pain and discomfort associated with pressure and friction points associated with performing Seated Core Exercises by providing a more distributed support structure.

In embodiments of the invention, the posterior support 19 exhibits a concave curvature ranging from a diameter of 100-500 mm (3.94-19.69 in) and the lumbar support 2 exhibits a convex curvature ranging from a diameter of 200-800 mm (7.87-41.49 in). The preferred embodiment incorporates a posterior support 19 with a curvature of diameter 240 mm (9.45 in) and the lumbar support 2 exhibits a convex curvature of diameter 400 mm (15.75 in).

In an embodiment of the invention as demonstrated in FIG. 1 and FIG. 3, a exercise support device 1 comprised of a posterior support 19 and integrated lumbar support 2 exhibits a posterior support further comprising of a void of material 3, or thru-hole, that encompasses a region proximal to the user's coccyx 10 and sacral 11 areas for use during Seated Core Exercises. The integrated lumbar support exhibits a convex contoured form support that will be appreciated by those skilled in the art to provide contoured support to the lumbar region of the back proximal to the lumbar vertebrae (L1, L2, L3, L4 and L5) support the natural form of the curvature in the lumbar region, as demonstrated by FIG. 4B, of the spine commonly referred to as the lumbar and lumbosacral curvatures.

Embodiments of the invention may be produced from any material including but not limited to at least one of the following: polymeric materials, metals, and other materials organic and inorganic and may comprise a combination of any such material. It is preferable that utilized materials comprise of inorganic polymeric materials further comprising of an internal wall structure creating internal gas pockets to minimize overall weight of the exercise support device.

In an embodiment of the invention comprising a exercise support device with integrated lumbar and posterior supports exhibiting a void intended to encompass at least a portion of the coccyx region is comprised of at least one density of polymeric structure. It is preferred that said polymeric structure is characterized by a non-absorbent cellular structure. This may be accomplished with an internal cellular structure of adjacent but fully enclosed gas-pockets such as a closed-cell foam. It is further preferred that said polymeric non-absorbent structure is self-skinning. It will be appreciated by one skilled in the art that self-skinning compounds inherently develop a characteristic integral higher density skin at a boundary layer such as at the interface surface between said compound and that of a mold used during the production process. Self-skinning compounds provide characteristic properties such as, but not limited to water resistance, chemical resistance and/or UV resistance. In an embodiment, the exercise support device comprises at least one closed-cell self-skinning urethane foam of 6-25 lbs density. Alternative embodiments of the exercise support device may incorporate polyurethane foam to form the structure.

In an embodiment, the exercise support device comprises a rigid or semi-rigid substrate on which the urethane form is formed to add structural rigidity to the exercise support device. Said substrate may be constructed of materials including but not limited to polymeric materials, metals, materials organic and inorganic and may comprise a combination of any such material. It is preferred that in the presence of such a substrate, that said substrate comprises a semi-rigid or rigid plastic or wood layer to provide further structure to the exercise support device to provide structural rigidity while minimizing overall weight of said exercise support device.

Figure 2A:
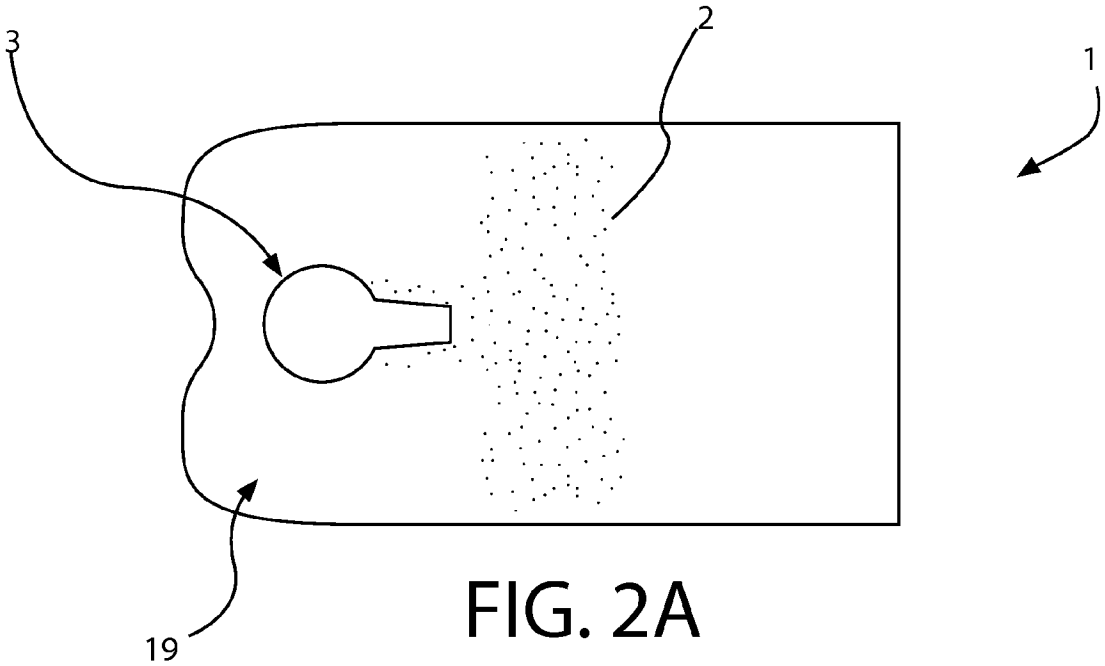
FIG. 2A is a top view of an embodiment of the exercise support device
Figure 2B:
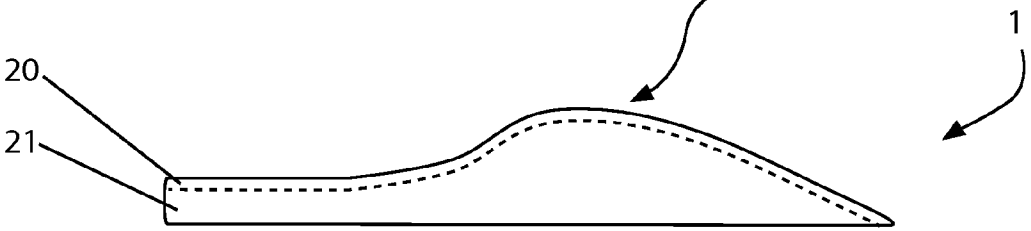
FIG. 2B is a side view of an embodiment of the exercise support device

In the preferred embodiment, the exercise support device comprises two layers of differing density non-absorbent urethane foam: a structural-layer and an interface-layer. As demonstrated in FIG. 2B, the structural-layer 21 provides the surface and structure in contact with the support surface, such as the floor, upon which the exercise support device rests. The interface-layer 20 provides connectivity and cushioning between the user and the structural-layer. In another embodiment of the invention, the structural-layer comprises 80-85% closed cell urethane foam of 6-10 lb density and further comprises an interface-layer of closed-cell self-skinning urethane foam of 15-25 lb density. The interface-layer characterized by the higher density provides a UV resistant, water resistant and fire retardant boundary. In the preferred embodiment, the structural-layer comprises a 6 lb density closed-cell urethane structural-layer and the interface-layer comprises 17 lb density closed-cell self-skinning interface-layer.

In an embodiment of the invention, the problem of increased discomfort or pain associated with performing Seated Core Exercises is solved by a exercise support device with posterior support integrated with a convex contoured lumbar support. Said exercise support device is sized to accommodate a broad range of user sizes, thereby accommodating users ranging from children to full-grown adults of any height.

In the preferred embodiment the exercise support device is 300 mm (11.81 in) in width, 500 mm (19.69 in) in length and 90 mm (3.54 in) in height. The posterior support of this preferred embodiment is further characterized by a recess providing pressure relief surrounding at least an area of the user's coccyx region. In use, the user sits atop the recess orienting their coccyx with the recess prior to commencing Seated Core Exercises. In doing so, the user is provided relief from negative aspects associated with Seated Core Exercises including but not limited to pressure, friction and skin-to-skin interaction resulting from the posture the user adopts and the motions associated with Seated Core Exercises.

In an embodiment, the invention comprises a lumbar support integrated with a posterior support exhibiting a recess proximate to the user's coccyx and sacral areas for use during Seated Core Exercises. The lumbar support preferably provides a convex contoured form to provide increased lumbar support and enhanced physiological form. In such embodiment, said posterior support exhibits a void of material providing relief from negative aspects associated with Seated Core Exercises. Resultantly, the area of the body encompassed by the recess is at least partially held in suspension. This suspension of the coccyx and a portion of the sacral region above the support surface provides further mitigation of negative effects felt by the user by reducing friction with the user's bodily interface with the ground and skin-to-skin interaction.

In an embodiment, the convex contoured lumbar support further comprises of a recess that extends coincident with the sagittal plane of the user providing a decrease in contact pressure felt by the users spine. Said groove is intended at least from the sacral area to the lower lumbar area but may extend further to the thoracic or cervical spinal area as allowable by the size of the exercise support device.

In the preferred embodiment as demonstrated by FIGS. 3A, 3B and 3C, the invention comprises an exercise support device intended for use in the execution of Seated Core Exercises comprising of a posterior support integrated with a lumbar support. Said posterior support further exhibits a void 3. Said void is preferably round toward the posterior end and tapers as demonstrated by FIG. 3C as it extends toward the lumbar and sacral region. This void mitigates and eliminates contact with the ground in the aforementioned portion of the region surrounding the coccyx and sacrum of the user during the repetitive motions of Seated Core Exercises to mitigate and eliminate the negative aspects associated with such exercises. Resultantly, the coccyx and the Supraspinous Ligament up to the superior surface of the sacrum are suspended above the floor or other supporting surface used by the user when engaging in Seated Core Exercises.

Due to the nature of fitness exercises and sweat produced during the execution of Seated Core Exercises, this embodiment further comprises a non-toxic, slip-proof, waterproof exterior surface. Said exterior surface may also or alternatively comprise materials or coatings that are UV, water resistant and fire retardant. Such materials may comprise of, but are not limited to foams, fabrics or polymeric materials such as urethane.

The preferred method of use involves the following steps:

1. The user sits on the exercise support device with their coccyx oriented such that there remains little to no contact between the user's coccyx and a portion of the sacral area with the exercise support device or supporting surface, such as the floor, and the lumbar support extending toward the users head along centered on the sagittal plane.

2. The user further determines a comfortable seating position to ensure proper alignment of the lower back on the lumbar support while maintaining the coccyx within the radial portion of the void in the posterior support. This enables the user to have posterior support with contact and skeletal support on the ischium, commonly referred to as the 'sit' or 'sitting' bones, and no pressure or friction inducing contact with the coccyx and some sacral areas to the floor or other supporting surface upon which the exercise support device is supported by during use.
3. The user performs Seated Core Exercises as appreciated by one skilled in the art or as normally performed without the exercise support device. This method of use of the seated exercise mat enables movement associated with Seated Core Exercises while mitigating or eliminating the aforementioned negative aspects.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The descriptive labels associated with the numerical references in the figures are intended to merely illustrate embodiments of the invention, and are in no way intended to limit the invention to the scope of the descriptive labels.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The terms "coupled" and "linked" as used herein is defined as connected, although not necessarily directly and not necessarily mechanically. A device or structure that is "configured" in a certain way is configured in at least that way, but may also be configured in ways that are not listed. Also, the sequence of steps in a flow diagram or elements in the claims, even when preceded by a letter does not imply or require that sequence.

I claim:

1. An exercise support device, comprising:
a posterior support with a substantially concave form;
a void extending through the entirety of the posterior support, wherein the void is configured to encompass a user's coccyx;
a lumbar support with a substantially convex form; and
a bottom surface, wherein the bottom surface extends from at least a position below the posterior support to at least a position below the lumbar support, and wherein the exercise support device is configured such that the bottom surface contacts a ground surface and remains in contact with the ground surface when the user performs a Seated Core Exercise.

2. The exercise support device of claim 1 wherein the void has a substantially tear-drop shape.

3. The exercise support device of claim 1 wherein the exercise support device comprises a closed-cell self-skinning urethane foam.

4. The exercise support device of claim 1 wherein the void has a keyhole shape.

5. The exercise support device of claim 1 wherein at least a portion of the void has a round shape.

6. The exercise support device of claim 1 wherein at least a portion of the void has linear portions that form an angle.

7. The exercise support device of claim 1 wherein the exercise support device comprises polyurethane foam.

8. An exercise support device, comprising:
a posterior support with a substantially concave form;
a recess disposed in the posterior support, wherein the recess is configured so that there is substantially no contact between the exercise support device and a user's coccyx when the user performs a Seated Core Exercise;
a lumbar support with a substantially convex form; and
a bottom surface, wherein the bottom surface extends from at least a position below the posterior support to at least a position below the lumbar support, and wherein the exercise support device is configured such that both the position below the posterior support and the position below the lumbar support of the bottom surface contacts a ground surface and remains in contact with the ground surface when the user performs a Seated Core Exercise.

9. the exercise support device of claim 8 wherein the recess is a void.

10. The exercise support device of claim 8 wherein the recess has a keyhole shape.

11. The exercise support device of claim 8 wherein at least a portion of the recess has a round shape.

12. The exercise support device of claim 8 wherein at least a portion of the recess has linear portions that form an angle.

13. The exercise support device of claim 8 wherein the exercise support device comprises polyurethane foam.

14. An exercise support device, comprising:
a top surface having:
a posterior support with a substantially concave form;
a lumbar support with a substantially convex form; and a recess, wherein the recess is configured so that there is substantially no contact between the exercise support device and a user's coccyx when a user performs a Seated Core Exercise; and a bottom surface, wherein the bottom surface extends from at least a position below the posterior support to at least a position below the lumbar support, and wherein the exercise support device is configured such that the bottom surface contacts a ground surface and remains in contact with the ground surface when the user performs a Seated Core Exercise.

15. The exercise support device of claim 14 wherein the recess is a void.

16. The exercise support device of claim 14 wherein the recess has a keyhole shape.

17. The exercise support device of claim 14 wherein at least a portion of the recess has a round shape.

18. The exercise support device of claim 14 wherein at least a portion of the recess has linear portions that form an angle.

19. The exercise support device of claim 14 wherein the exercise support device comprises polyurethane foam.

20. The exercise support device of claim 14 wherein a length of the bottom surface is substantially equal to a length of the top surface.

* * * * *